United States Patent [19]

Zambrow et al.

[11] 4,006,016

[45] Feb. 1, 1977

[54] PRODUCTION OF HIGH DENSITY POWDERED METAL PARTS

[75] Inventors: John L. Zambrow, Deerfield; Rudolph M. Hempel, Palatine; Louis T. Feng, Barrington, all of Ill.

[73] Assignee: Borg-Warner Corporation, Chicago, Ill.

[22] Filed: July 23, 1975

[21] Appl. No.: 598,442

[52] U.S. Cl. ..... 75/221; 29/420.5; 75/200; 75/226

[51] Int. Cl.[2] ..... B22F 3/14; C22C 1/04; B22F 3/16

[58] Field of Search ..... 75/200, 226, 221; 29/420.5

[56] References Cited

UNITED STATES PATENTS 3,720,512 3/1973 Yamaguchi et al. ..... 75/226 X

OTHER PUBLICATIONS

Brown, G. T. et al., "Experimental and Practical Aspects of the Powder Forging Process" in Int. J. Pow. Met. 6(4): pp. 29–42, Oct., 1970.

Hirschorn, J. S. et al., "The Forging of Powder Metal Preforms," In Metal Forming 37(11): pp. 320–327, Nov., 1970.

Pietrocini, T. W. et al., "Fatigue and Toughness of Hot Formed Cr–Ni–Mo and Ni–Mo Prealloyed Steel Powders," in Int. J. Pow. Met. 6(4): pp. 19–25, Oct., 1970.

Lally, F. T. et al., Isothermal Forging of Precision Metal Powder Components, Report No. R-RR-T-6-95-73 (AD-780-044) Available NTIS, Dec., 1973.

*Primary Examiner*—Richard E. Schafer

*Attorney, Agent, or Firm*—James A. Geppert

[57] ABSTRACT

A process of forming powdered metal into finished or near-finished, high-strength, structural parts of complex configurations wherein a metal powder preform is heated to a temperature of approximately 2100° F and formed at relatively low pressures in the range of approximately 19 to 39 tons per square inch over a short contact time interval in a preheated forming die composed of a high temperature, high strength superalloy to produce a metal part having a density of 99+% of theoretical density. The preform is formed from a prealloyed metal powder blended with graphite and a lubricant, compacted to a density in the range of 70 to 80% of theoretical density, and heat treated for oxide reduction and solutioning of the graphite therein. The preform must be rapidly transferred from the heat treatment operation to the preheated forming die to minimize reoxidation and cooling of the preform.

13 Claims, 1 Drawing Figure

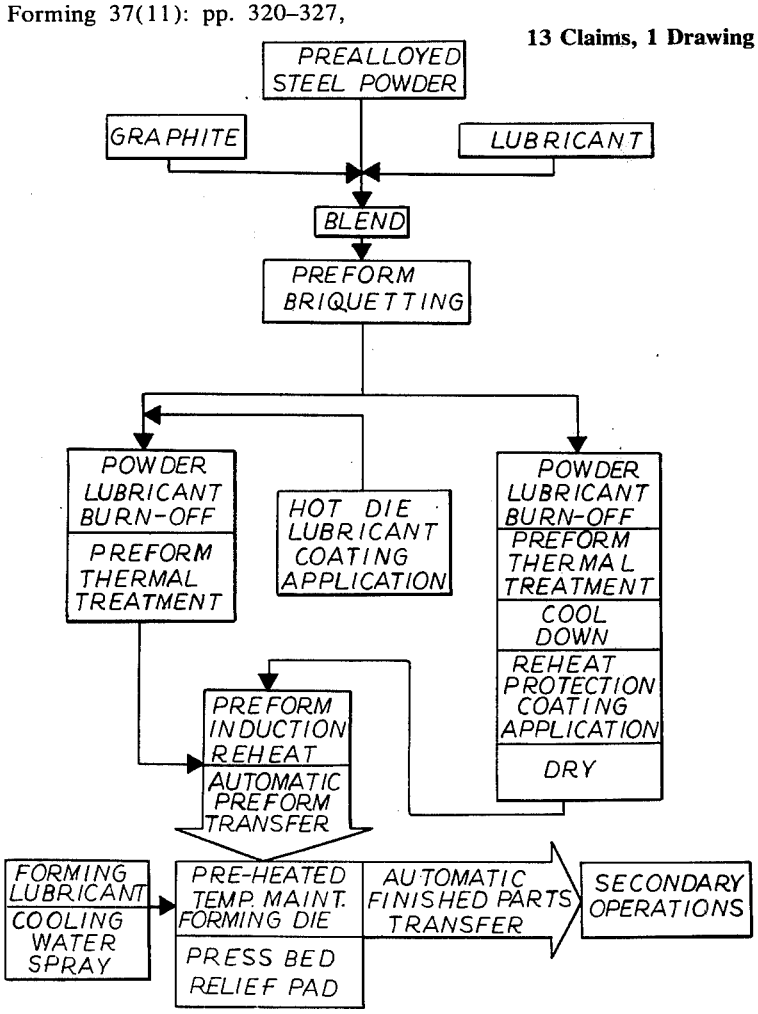

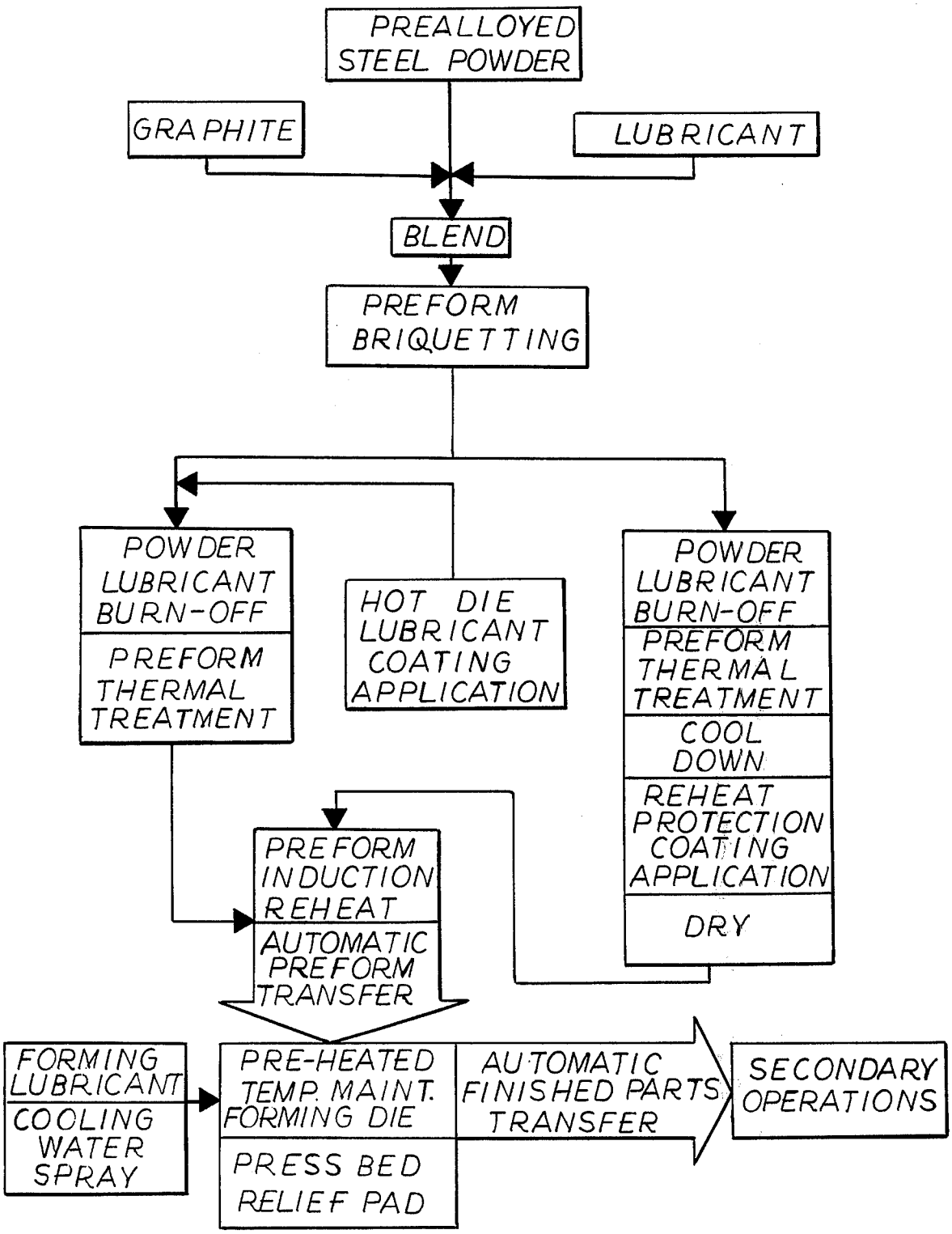
PREALLOYED STEEL POWDER
GRAPHITE
LUBRICANT
BLEND
PREFORM BRIQUETTING
POWDER LUBRICANT BURN-OFF
PREFORM THERMAL TREATMENT
HOT DIE LUBRICANT COATING APPLICATION
POWDER LUBRICANT BURN-OFF
PREFORM THERMAL TREATMENT
COOL DOWN
REHEAT PROTECTION COATING APPLICATION
DRY
PREFORM INDUCTION REHEAT
AUTOMATIC PREFORM TRANSFER
FORMING LUBRICANT
COOLING WATER SPRAY
PRE-HEATED TEMP. MAINT. FORMING DIE
PRESS BED RELIEF PAD
AUTOMATIC FINISHED PARTS TRANSFER
SECONDARY OPERATIONS

PRODUCTION OF HIGH DENSITY POWDERED METAL PARTS

BACKGROUND AND SUMMARY OF THE INVENTION

The present invention relates to the production of high density powdered metal parts and more particularly to a process of forming the powdered metal part to a density of 99+% of theoretical density.

The molding of metal powders has been extensively employed in the production of complicated shapes of soft metals, particularly iron and low carbon steels. The method usually employs a fine metal powder which is pressed or compacted under high pressure to cold weld the metal particles together and then sintered at a high temperature sufficient to form a coherent solid article. Powder metallurgy is currently used for the production of parts that do not require the strength and ductility of wrought steel. In many cases, the tolerances of a powder compact that is pressed and sintered can be held close enough so that no final machining is required; while in other cases, close tolerances can be maintained by coining the parts after sintering. The use of powder metallurgy processes for forming metal articles of various shapes and types is a preferred method of manufacture wherever possible in view of the rapidity of the manufacturing process, its relative simplicity, and the relatively low cost involved. If the mechanical properties of the parts could be improved, the area of usefulness of powder metallurgy in the production of steel parts would be greatly expanded.

The utility of powdered metal articles produced by pressing and sintering frequently depends upon the fact that their physical properties, especially their strength, conform or approach as far as possible to the properties of parts produced from a fused mass. The physical properties of sintered metal articles are influenced to a considerable extent by the production process. The primary cause of the low strength of powder metallurgy steel is the high level of porosity. Typically, a part made from steel powder with a single pressing operation and sintering will be 85% dense (15% porosity). Porosity can be reduced by repressing and resintering but porosities of less than 7% are difficult to achieve and are economically impractical. Only at low pressures and low densities does an increase of the pressure also bring a proportional increase of the density. At higher pressures and higher densities, on the other hand, an increase of the pressure leads only to a relatively slight increase of the density. This is attributable to the fact that in the pressing of metal powders, a cold work-hardening occurs which increases the deformation resistance of the powder particles, and thus slows the compressing operation, and finally brings the latter to a halt. For this reason, it is difficult to produce sintered parts of high density with pressures at which tool wear and tool breakage are kept within economically acceptable limits.

Further densification has also been achieved by a hot pressing operation. The powder is loaded into a hot die and pressed, however, the method is slow because of the long time required to heat the powder and, therefore, is economically feasible only for expensive materials. As powdered metal components usually have a complex geometry, such as gear teeth, splines, hubs, webs, etc., that are not capable of forming by the simple fabricating processes such as rolling, drawing or swaging, and as these components are made in extremely large quantities and must be interchangeable, it is important that any process used for such fabrication be capable of making parts repeatedly within very small dimensional tolerances and with uniformly high densities. The present invention overcomes the deficiencies of prior known processes in providing a finished or nearly finished powdered metal part having a density of 99+% of theoretical density.

Among the objects of the present invention is the provision of a process for making powdered metal parts into finished or nearly finished, high-strength, structural steel parts of complex configurations. This method includes the basic steps of cold forming a suitable blend of powdered metals into a coherent body or preform having a prescribed density, thermally treating the preform to achieve prescribed chemical and metallurgical properties, transferring the preform at an elevated temperature into a temperature-maintained die, and forming the preform under relatively low pressure into a finished or nearly-finished high density part.

Another object of the present invention is the provision of a powder metallurgy process wherein the starting material is a prealloyed steel powder that is blended with graphite and a suitable lubricant and then preformed into a compact approaching the shape of the finished part. The density of the preform is limited to approximately 80% of theoretical to insure that the pores of the preform are mostly inerconnected. The amount of graphite added to the metal powder must be sufficient to reduce the oxides therein and yet bring the final carbon content of the part within $\pm 0.05\%$ carbon of the desired final carbon content.

A further object of the present invention is the provision of a process for forming powdered metal wherein the preform is thermally treated at an elevated temperature to reduce the oxygen content of the preform to 300 parts per million or less. The preform at the elevated temperature is then preferably directly transferred to a hot pressing die with the transfer time minimized to avoid reoxidation or decarburizing the surface of the compact. The rapid transfer of the preform also accomplishes a minimal heat loss of the preform so that the final densification of the article is accomplished at an elevated temperature near the thermal treatment temperature.

The present invention relates to a process of hot densification of a powdered metal preform in a hot pressing die at a relatively low pressure. To achieve the hot densification of the powdered metal preform, the die is preheated to a temperature within the range of approximately 1000° to 1400° F, and the temperature of the transferred preform is approximately 1950° F. The forming pressure for the hot densification is in the range of 19 to 39 tons per square inch, and the die composition for the hot densification is a high nickel-based alloy to reduce the wear and breakage thereof during repeated pressing operations. The final temperature of the ejected, finished or near finished part is approximately 1500° F, and after pressing, the powdered metal article is ejected from the die and transferred to a container in which it can immediately be cooled by a liquid quench, such as oil or water, or in an inert atmosphere, such as nitrogen, to prevent the part from becoming oxidized before it is cooled to a sufficiently low temperature. The density of the final finished part exceeds 99% of theoretical density. In some cases, it may be necessary to perform additional operations in order to bring the part to its final geometry and physical characteristics. Secondary operations include grinding, if extremely close tolerances are required, or transverse holes or undercuts may be machined into the part which cannot be done in the forming operation. Additionally, the part may be carburized or heat treated if such treatment is required to meet the final physical properties in the body and surface of the part.

Further objects are to provide a construction of maximum simplicity, efficiency, economy, and ease of operation, and such further objects, advantages and capabilities as will later more fully appear and are inherently possessed thereby.

DESCRIPTION OF THE DRAWING

The drawing is a flow diagram representing the steps of the method of the present invention.

DESCRIPTION OF THE PREFERRED EMBODIMENT

The powder metallurgy industry has had a rapid growth with principal markets in the fabrication of small complex iron or steel parts that were prohibitively costly to make by metal-cutting or casting methods. One large market was in structural parts, such as transmission gears and other drive-line components, for the automotive industry; however, in order to be acceptable to the industry, it was necessary for the powdered metal parts to have mechanical properties equivalent to parts made from wrought steel. Wrought steel parts are characterized by their high impact and fatigue strengths, which are in turn dependent on other mechanical, physical and chemical properties of the steel, including tensile strength, yield strength, ductility and chemical composition. The optimum properties in the structural components are usually obtained by subjecting the components to a carefully programmed heat treatment. The quality of the wear surfaces of the components is of primary importance and this is usually achieved by some surface treatment such as carburizing, nitriding, phosphatizing, and other will known treatments.

Recently, hot forming of powdered metals has been utilized to improve the characteristics of the final metal parts and attempt to more closely approach the mechanical properties and characteristics of wrought metal. As currently practiced, a suitable blend of powdered metals and additives is cold-formed into a coherent body, and this body is thermally treated or sintered resulting in an article that is easily handled without undue breakage and, for some purposes, will become the finished product. Finally, while at some elevated temperature, the preform is transferred to a forming die and formed under pressure into a finished or nearly-finished high density part. Within this general framework, two fundamentally different preform configurations can be found in use. One reflects a simple geometric shape, such as a cube, solid or hollow cylinder, truncated cone, etc., and the other approximates the shape of the finished part. With the first shape, gross deformation or "forging" occurs during final forming; while with the second shape, final forming consists primarily of material consolidation or "hot densification". Generally, practice shows that under given conditions of preform and die temperatures, forging requires a higher unit forming pressure (approximately 80 tons per square inch) and produces a higher density final part with attendant higher mechanical properties. However, the die life with forging is much lower than with densification and often makes forging economically unacceptable.

The process of the present invention as shown in the drawing uses the "hot densification" approach to forming. Prealloyed steel powder is the starting material and is available commercially in the required quantities. The powder is blended with graphite and a suitable lubricant either by the powder vendor or in the powder metallurgy fabrication plant. The principal function of the graphite is to reduce some of the oxides which are present in the as-received powder and to raise the carbon content of the finished part to the level necessary to achieve the required mechanical properties. The lubricant is added to facilitate the cold compaction of the powder into a shape strong enough for subsequent handling. The amount of graphite added is important since there must be enough to reduce the oxides and yet bring the final carbon content of the part within the comparatively narrow limit of ±0.05% carbon of the desired final carbon content, which may vary for different parts depending on whether they are to be through-hardened or carburized for surface hardness only.

The blended powder is then preformed at room temperature into a compact approaching the shape of the finished part. The density of the preform is limited to a range of approximately 70–80% of theoretical. This is to insure that the pores of the preform are mostly interconnected so that the gases that will be generated in the reduction step can be easily expelled and so that the interior of the preform will readily be accessible to the reducing gases. Also, the porosity of the preform influences the mechanical working of the preform in the hot pressing operation.

The preform is then subjected to a thermal treatment which involves first of all a low temperature treatment under 1000° F in a high purity hydrogen atmosphere to volatilize the lubricant which had been added to facilitate the preform briquetting. The temperature of the preform is then raised to a temperature of approximately 2100° F or higher for approximately 30 minutes in hydrogen or disassociated ammonia having a dew point in the range of −30° to −50° F or less. The purpose of this thermal treatment is to reduce the oxygen content of the preform to 300 parts per million or less. The graphite blended into the prealloyed steel powder has a threefold purpose during these initial stages. The graphite will aid the lubricant by acting as a particle lubricant during the preform briquetting; during the thermal treatment, the graphite is utilized for deoxidizing of the preform material; and, also, the graphite is solutioned into the preform to bring the composition up to the desired carbon level. During this thermal treatment, sintering also occurs.

Current hot-formed powder metallurgy practices reduce the flow stress of the powdered metal preform's material by elevating its temperature, prior to final forming, within the range of 1550°–1800° F. The preform is then transferred into a die which is temperature-maintained within the range of 575° to 800° F. Graphite-based coatings in general usage and acting, variously, as (a) preform reoxidation protection coatings during reheat and/or (b) parting and/or lubricating agents in the die during the final forming operation are relatively good conductors of heat. Therefore, in spite of relatively short contact times between the hot powdered metal preform and die during the final forming, the preform does lose heat to a lower temperature die cooling water circulation. The preheated preform is transferred in air over a transfer time of approximately four seconds to the preheated die with the temperature of the transferred preform lowered to approximately 1950° F. The powdered metal compact is formed to its final dimensions under a controlled pressure of approximately 24.1 tons per square inch for a contact time of 0.32 seconds. Control of the forming pressure was by means of a conventional hydraulic press bed relief pad. Upon ejection, the part temperature is approximately 1550° F and the part is transferred to an oil quench. The final part bulk density was 7.81 grams per cubic centimeter (99.5% of theoretical density). The final formed article could then be subjected to secondary operations as required.

Completely reversed tortional fatigue testing at a ± 500 foot pounds level demonstrated the ability of these high density hot formed powdered metal "hubs" to achieve the $1 \times 10^6$ load cycle life standard established for the wrought steel "hub" counterparts.

EXAMPLE II

To achieve a nominal SAE/AISI 4617 grade steel item, a commercial grade of 4600 series (nickel-molybdenum) prealloyed steel powder was blended with 0.4% graphite and compacted using die wall lubrication into a preform having a density of 5.5 grams per cubic centimeter (70% of theoretical density). This preform was next held at 2135° F for ½ hour in an atmosphere of disassociated ammonia having a dew point of −57° F. At the conclusion of the thermal treatment, the preform was quickly manually transferred from the furnace into an argon blanketed, prelubricated, 1400° F temperature-maintained, Udimet 700 die and immediately subjected to a unit pressure of 19.1 tons per square inch for a period of one minute; after which it was ejected and allowed to air cool. The density of the cleaned final article was 7.78 grams per cubic centimeter (99.0% of theoretical density).

This formed article was fabricated into a notched, case-carburized laboratory fatigue specimen and subjected to a unidirectional maximum nominal bending stress of 61,000 pounds per square inch, and a life of over 400,000 load cycles was obtained. For this same fatigue life, a similarly fabricated and heat treated SAE/AISI 4617 wrought steel specimen could resist a maximum nominal bending stress of 64,500 pounds per square inch. The 5% discrepancy of the hot formed powdered metal part versus a wrought steel part is considered well within the limits of scatter in fatigue data and the equivalency of fatigue properties of a high density hot form powder metal part in wrought materials was considered demonstrated.

EXAMPLE III

A commercial, modified nickel-molybdenum prealloyed steel base powder having the following nominal chemistry:

| | |
|---|---|
| Manganese | 0.30% |
| Molybdenum | 0.60% |
| Nickel | 0.45% |
| Carbon | 0.02% maximum |
| Phosphorus | 0.02% maximum |
| Sulfur | 0.02% maximum |
| Oxygen | 0.25% maximum |
| Iron | balance |

was blended with 0.67% graphite and 0.75% (wax) lubricant (all percentages expressed as weight). This blend was conventionally briquetted into an approximately 5.9 grams per cc. (75% of theoretical density) preform approximating the final parts' configuration and commercially sintered for ½ hour at 2080° F using disassociated ammonia atmosphere at a dew point equal to or less than −30° F. Analysis indicated that oxides had been reduced to less than 0.045% and combined carbon was in the range of 0.50 to 0.58%. Sintered preforms were next batch dipped in a water-based colloidal graphite solution to provide 1) oxidation protection during reheat for final forming, and 2) an additional degree of lubricity during forming. After suitable drying, the protectively coated preforms were induction heated to 2,075° F ± 25° F, automatically transferred (in air) in approximately 1 second into a previously graphite-lubricated Udimet 700 die maintained at 1000° F and formed under a unit pressure of 38.9 tons per square inch with a contact time of 0.12 seconds. Final as-formed part density was 7.81 grams per cubic centimeter (99.3% of theoretical density).

As shown in the flow diagram of the drawing, a hot die lubricant coating, such as boron nitride in a slurry, may be applied to the preform prior to the powder lubricant burn-off and thermal treatment for the left-hand flow line. The hot die lubricant coating is utilized as an alternative to adding the forming lubricant directly to the heated forming die. The preform is dipped in the slurry and air-dried prior to the thermal treatment.

Although disassociated ammonia is disclosed in the examples for the oxide reduction thermal treatment, a dry hydrogen atmosphere having a dew point in the range of −30° to −50° F or less can also be used at a temperature of approximately 2100° for a time interval in the range of 20 to 30 minutes. Thus, a method is disclosed for the formation of a high density product of powdered metal utilizing a relatively low force and preserving the die life under the higher temperatures involved for the final forming operation.

I claim:

1. A method of forming a powdered metal article having a high density in the order of 99% or greater of theoretical density, comprising the steps of: pressing a preform having a density in the range of 70 to 80% of theoretical density from a metal powder; heating the preform for approximately 20 to 30 minutes in a controlled atmosphere at a temperature in the range of 2000° F to 2100° F to produce a treated preform having from 200 to 300 parts per million oxygen; heating the treated preform to a temperature of approximately 2100° F; rapidly transferring the heat-treated preform into a forming die of a nickel-based alloy maintained at a temperature in the range of 1000° F to 1400° F; applying a forming pressure of 19.1 to 39 tons per square inch to the preform in the die for a contact time in the range of 0.05 seconds to 1.00 minute; and ejecting the article from the die and cooling.

2. A method of forming a powdered metal article as set forth in claim 1, wherein the heat-treated preform is directly transferred from the controlled atmosphere to the heated die.

3. A method of forming a powdered metal article as set forth in claim 1, wherein the heat-treated preform is cooled to room temperature and then reheated to a temperature of approximately 2100° F.

and the flow stress of the preform is raised at, and for a distance slightly below, all preform-die contact surfaces. This increase in preform material flow stress necessitates the use of higher unit forming pressures for a given final part configuration.

The present invention minimizes the preform-die temperature differential by raising the die's operating temperature, so that a lowered flow stress of the preform's material could be better maintained during forming and lower unit forming pressures would result. These lower forming pressures could be expected not only to reduce the forming-press tonnage requirements, but also to enhance die life. Therefore, the preform at approximately 2100° F from the thermal treatment is then transferred directly to the hot pressing die to which a suitable forming lubricant has been added. A total transfer time from the furnace to the press must be 4 seconds or less if the transfer is made in air to reduce the possibilities of cooling and oxidation of the material. Alternatively, a passage could be provided so that the transfer could be made in an inert atmosphere, for example nitrogen, argon, helium, etc. The transfer time must be kept short to avoid oxidizing or decarburizing the surface of the compact, and the temperature of the preform may drop during transfer to about 1950° F. The forming die is preheated to a temperature in the range of 1000° to 1400° F to reduce the temperature differential between the forming die and the heat treated preform and minimize die quenching of the preform.

Immediately after transfer, the preform is subjected to a pressure in the range of approximately 19 to 39 tons per square inch for a contact time in the range of approximately 0.05 second to 1.00 minute to raise the density of the final part to above 99% of theoretical density. Immediately after pressing, the compact is ejected from the die and transferred to a container in which it can be immediately cooled, as for example by oil quenching, or cooled in an inert atmosphere, such as nitrogen, which will prevent the part from becoming oxidized before it can be cooled to a sufficiently low temperature. Although the hot forming die is maintained at a temperature within the range of 1000° to 1400° F, it has a tendency to become heated above this range because of the heat transferred from the high temperature preform. Therefore, it is necessary to cool the die between successive pressings, and this is conveniently accomplished by cooling with a water spray; and additionally, a lubricant such as graphite may be added to the water to provide the forming lubricant in order to insure that the compact will not react with the die parts.

It is necessary that the die be able to withstand a large number of cycles, on the order of tens of thousands, in order to achieve an economical operation. This is accomplished as described above by using a die material which will withstand the temperatures and pressures noted above over the life of the die. It has been found that a high temperature high nickel-based alloy, such as Udimet 500, Udimet 700, or Waspalloy, will meet these requirements. Up to 20,000 parts averaging more than 99% of theoretical density can be made in a single die with the critical diameter changing by less than 0.002 inches. This is sufficiently close tolerance for many highly stressed automotive parts.

In some cases, it may be necessary to perform additional operations in order to bring the part to its final geometry and physical characteristics. Secondary operations may be performed, such as grinding if extremely close tolerances are required, or transverse holes or undercuts which cannot be achieved in the forming operation may be machined into the part. Additionally, the part may be carburized or heat treated if such treatment is required to meet the final physical properties in the body and surface of the part. It has been found that by this process, the resulting plain carbon steel and alloy steel parts are similar enough to wrought steel that they can be heat-treated or surface conditioned to improve performance; for example, carburizing, carbonitriding, etc., by the same procedures as would be used for wrought steel. In addition, the quality of the parts was such that they could be welded with an electron beam to make components that would withstand the fatigue test normally required of structural automotive parts.

The following examples are illustrative of the present process:

EXAMPLE I

A prealloyed steel powder has the following specifications with all percentages being expressed as weight percentages:

| | | |
|---|---|---|
| Iron | 99.4% | minimum |
| Carbon | 0.02% | maximum |
| Manganese | 0.30% | maximum |
| Phosphorous | 0.010% | maximum |
| Sulphur | 0.020% | maximum |
| Silicon | 0.05% | maximum |
| Oxygen | 0.15% | maximum |

A screen analysis utilizing a Tyler sieve series showed the following:

| | |
|---|---|
| +80 | 0.2% maximum |
| −80 + 100 | 4.0% maximum |
| −325 | 25.0 to 35.0% |

The prealloyed steel powder of 99.6% by weight was blended with graphite of 0.40% by weight and a suitable lubricant, such as Acrawax "C", of 0.75% by weight of the steel powdergraphite mix. The apparent density of the blended materials was in the range of 3.0 to 3.1 grams per cubic centimeter.

The blended powder was introduced into a preform die and pressed at room temperature to a density in the range of 5.86 to 5.92 grams per cc. The density of the preform was in the range of 70 to 80% of theoretical density. The lubricant was burned off and the preform thermally treated in a disassociated ammonia atmosphere having a dew point equal to or less than −30° F and a treatment temperature of 2080° F over a time interval of 30 minutes. The thermal treatment reduced the oxides in the preform to a final oxygen content in the range of 0.03 to 0.02% by weight. The preform was cooled to room temperature and at a later time reheated to a temperature in the range of 300° to 325° F, dip coated in a water-based colloidal graphite solution and air dried, and then reheated by induction heating in an argon atmosphere to a temperature of 2050° F ± 50° F. A forming die is preheated with the die cavity temperature of approximately 1120° F and an upper punch temperature of approximately 100° F; the die components and heater block materials being formed of Udimet 700 and Waspalloy. A forming lubricant is added to the die and the tooling system has provisions for 4. A method of forming a powdered metal article as set forth in claim 3, wherein the cooled, treated preform is dipped in a colloidal graphite solution to provide oxidation protection during reheating for the forming operation.

5. A method of forming a powdered metal article as set forth in claim 4, wherein the treated preform is reheated in an argon atmosphere.

6. A method of forming a powdered metal article as set forth in claim 1, wherein the controlled atmosphere is disassociated ammonia having a dew point in the range of −30° to −50° F or less.

7. A method of forming a powdered metal article as set forth in claim 1, wherein the transferance of the preform from the heating furnace to the die is accomplished in approximately four seconds.

8. A method of forming a powdered metal article as set forth in claim 7, wherein the heated preform entering the forming die has a temperature of approximately 1950° F.

9. A method of forming a powdered metal article as set forth in claim 2, wherein the forming die is blanketed with an argon atmosphere to prevent oxidation of the hot treated preform.

10. A method of forming a powdered metal article as set forth in claim 1, wherein the controlled atmosphere is hydrogen having a dew point in the range of −30° to −50° F or less.

11. A method of forming a powdered metal article as set forth in claim 1, wherein the heat treatment of the preform solutions the graphite in the powdered metal throughout the preform.

12. A method of forming a powdered metal article as set forth in claim 1, wherein said metal powder is a prealloyed steel with the addition of graphite and a suitable lubricant, the initial portion of the heat treatment of the preform volatilizes the lubricant, and the graphite acts to deoxidize the preform.

13. A method of forming a powdered metal article as set forth in claim 1, in which said preform is near the desired shape of the final article, and the application of forming pressure provides a hot densification of the preform.

* * * * *

UNITED STATES PATENT OFFICE

CERTIFICATE OF CORRECTION

PATENT NO. : 4,006,016

DATED : February 1, 1977

INVENTOR(S) : JOHN L. ZAMBROW, et al

It is certified that error appears in the above-identified patent and that said Letters Patent are hereby corrected as shown below:

Column 6, line 65, change "100° F" to -- 1000° F --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*